United States Patent [19]

Terauchi

[11] Patent Number: 4,960,367

[45] Date of Patent: Oct. 2, 1990

[54] SLANT PLATE TYPE COMPRESSOR WITH VARIABLE DISPLACEMENT MECHANISM

[75] Inventor: Kiyoshi Terauchi, Isesaki, Japan

[73] Assignee: Sanden Corporation, Gunma, Japan

[21] Appl. No.: 276,798

[22] Filed: Nov. 28, 1988

[30] Foreign Application Priority Data

Nov. 27, 1987 [JP] Japan ..... 62-297700

[51] Int. Cl.[5] ..... F04B 1/28

[52] U.S. Cl. ..... 417/222; 417/270

[58] Field of Search ..... 417/222 S, 222, 270

[56] References Cited

U.S. PATENT DOCUMENTS

| | | | |
|---|---|---|---|
| 4,037,993 | 7/1977 | Roberts . | |
| 4,428,718 | 1/1984 | Skinner | 417/222 S |
| 4,685,866 | 8/1987 | Takenaka et al. . | |
| 4,687,419 | 8/1987 | Suzuki et al. | 417/222 S |
| 4,688,997 | 8/1987 | Suzuki et al. . | |
| 4,702,677 | 10/1987 | Takenaka et al. . | |
| 4,723,891 | 2/1988 | Takenaka et al. | 417/222 S |
| 4,730,986 | 3/1988 | Kayukawa et al. . | |
| 4,732,544 | 3/1988 | Kurosawa | 417/222 S |
| 4,752,189 | 6/1988 | Bearint et al. . | |

FOREIGN PATENT DOCUMENTS

| | | | |
|---|---|---|---|
| 258680 | 3/1988 | European Pat. Off. | 417/222 S |
| 283963 | 9/1988 | European Pat. Off. | 417/222 S |
| 300831 | 1/1989 | European Pat. Off. | 417/222 S |

*Primary Examiner*—Leonard E. Smith

*Attorney, Agent, or Firm*—Banner, Birch, McKie & Beckett

[57] ABSTRACT

A slant plate type compressor with a capacity or displacement adjusting mechanism is disclosed. The compressor includes a housing having a cylinder block provided with a plurality of cylinders and a crank chamber. A piston is slidably fitted within each of the cylinders and is reciprocated by a drive mechanism which includes a member having a surface with an adjustable incline angle. the incline angle is controlled by the pressure situation in the crank chamber. The pressure in crank chamber is controlled by control mechanism which comprises a passageway communicating between the crank chamber and a suction chamber and valve device to control the closing and opening of the passageway. The valve device includes a valve element which directly controls the closing and opening of passageway. A valve device includes a bellows valve element and a valve shifting element. The valve shifting element is coupled to the bellows to apply a force to the bellows and thereby shift a control point of the bellows in response changes in the discharge chamber pressure.

21 Claims, 4 Drawing Sheets

SLANT PLATE TYPE COMPRESSOR WITH VARIABLE DISPLACEMENT MECHANISM

BACKGROUND OF THE INVENTION

1. Technical Field

The present invention relates to a refrigerant compressor, and more particularly, to a slant plate type compressor, such as a wobble plate type compressor, with a variable displacement mechanism suitable for use in an automotive air conditioning system.

2. Description Of The Prior Art

It has been recognized that it is desirable to provide a slant plate type piston compressor with a displacement or capacity adjusting mechanism to control the compression ratio in response to demand. As disclosed in U.S. Pat. No. 4,428,718, the compression ratio may be controlled by changing the slant angle of the sloping surface of a slant plate in response to the operation of a valve control mechanism. The slant angle of the slant plate is adjusted to maintain a constant suction pressure in response to a change in the heat load of the evaporator of an external circuit including the compressor or a change in rotation speed of the compressor.

In an air conditioning system, a pipe member connects the outlet of an evaporator to the suction chamber of the compressor. Accordingly, a pressure loss occurs between the suction chamber and the outlet of the evaporator which is directly proportional to the "suction flow rate" therebetween as shown in FIG. 5. As a result, when the capacity of the compressor is adjusted to maintain a constant suction chamber pressure in response to appropriate changes in the heat load of the evaporator or the rotation speed of the compressor, the pressure at the evaporator outlet increases. This increase in the evaporator outlet pressure results in an undesirable decrease in the heat exchange ability of the evaporator.

Above mentioned U.S. Pat. No. 4,428,718 discloses a valve control mechanism, to eliminate this problem. The valve control mechanism, which is responsive to both suction and discharge pressures, provides controlled communication of both suction and discharge fluid with the compressor crank chamber and thereby controls compressor displacement. The compressor control point for displacement change is shifted to maintain a nearly constant pressure at the evaporator outlet portion by means of this compressor displacement control. The valve control mechanism makes use of the fact that the discharge pressure of the compressor is roughly directly proportional to the suction flow rate.

However, in the above-mentioned valve control mechanism, a single movable valve member, formed of a number of parts, is used to control the flow of fluid both between the discharge chamber and the crankcase chamber, and between the crankcase chamber and the suction chamber. Thus, extreme precision is required in the formation of each part and in the assembly of the large number of parts into the control mechanism in order to assure that the valve control mechanism operates properly. Furthermore, when the heat load of the evaporator or the rotation speed of the compressor is changed quickly, discharge chamber pressure increases and an excessive amount of discharge gas flows into the crank chamber from the discharge chamber through a communication passage of the valve control mechanism due to a lag time to such the action between the operation of the valve control mechanism and the response of the external circuit including the compressor. As a result of the excessive amount of discharge gas flow, a decrease in compression efficiency of the compressor, and a decline of durability of the compressor internal parts, occurs.

The variable displacement control mechanism in a slant plate type of compressor, in accordance with the present invention, was developed to take advantage of the relationship between discharge pressure and suction flow rate in a manner which overcomes the disadvantages of a prior art mechanism such as disclosed in the '718 patent. That is, the control mechanism of the present invention was designed to have a simple physical structure and to operate in a direct manner on a valve controlling element in response to discharge pressure changes, thereby resolving the complexity, excessive discharge flow and slow response time problems.

The '718 patent discloses a capacity adjusting mechanism used in a wobble plate type compressor. As is typical in this type of compressor, the wobble plate is disposed at a slant or incline angle relative to the drive axis, nutates but does not rotate, and drivingly couples the pistons to the drive source. This type of capacity adjusting mechanism, using selective fluid communication between the crank chamber and the suction chamber, however, can be used in any type of compressor which uses a slanted plate or surface in the drive mechanism. For example, U.S. Pat. No. 4,664,604, issued to Terauchi, discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used therein to refer to any type of compressor, including wobble and swash plate types, which use a slanted plate or surface in the drive mechanism.

SUMMARY OF THE INVENTION

It is an object of this invention to provide a slant plate type piston compressor having a capacity adjusting mechanism which compensates for the increase in pressure at the evaporator outlet when the capacity of the compressor is adjusted, to maintain a constant evaporator outlet pressure with the control mechanism having a simple structure and operating in a direct and responsive manner.

A slant plate type compressor in accordance with the present invention includes a compressor housing having a front plate at one of its ends and a rear end plate at its other end. A crank chamber and a cylinder block are located in the housing; and a plurality of cylinders are formed in the cylinder block. A piston is slidably fit within each of the cylinders and is reciprocated by a driving mechanism. The driving mechanism includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle relative to the drive shaft. The incline angle of the member is adjustable to vary the stroke length of the reciprocating pistons and thus vary the capacity or displacement of the compressor. The rear end plate surrounds a suction chamber and a discharge chamber. A passageway provides fluid communication between the crank chamber and the suction chamber. An incline angle control device is supported in the compressor and controls the incline angle of the coupling mechanism member in response to the pressure condition in the compressor.

The valve control mechanism includes a valve element opening and closing the passageway and a valve shifting element shifting the control point of the valve element in response to pressure changes in the discharge chamber by applying a force to the valve element.

Further objects, features and other aspects of the invention will be understood from the detailed description of the preferred embodiments of this invention with reference to the drawings.

DETAILED DESCRIPTION OF THE PREFERRED EMBODIMENTS

Figure 1:
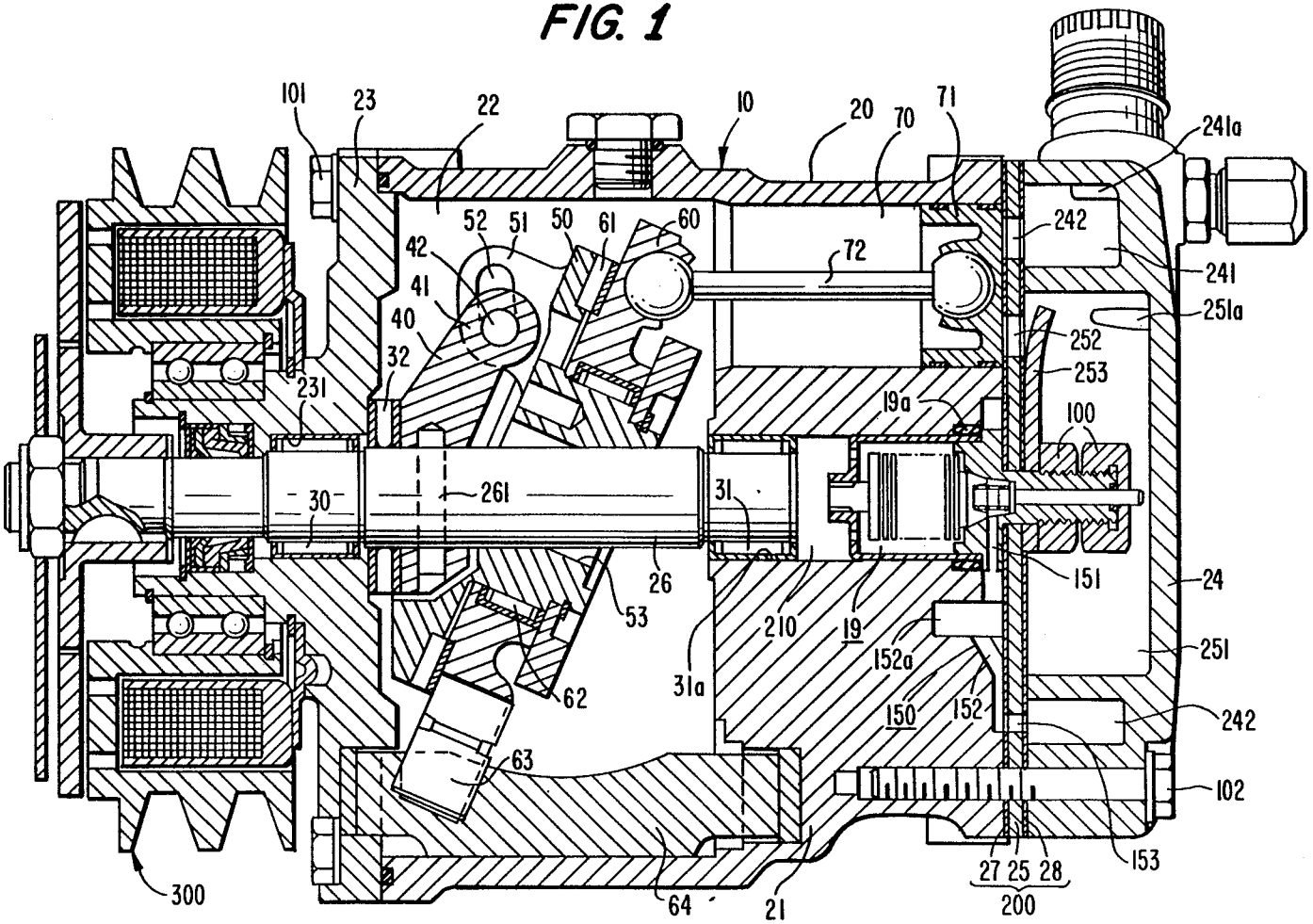
FIG. 1 is a vertical longitudinal sectional view of a wobble plate type refrigerant compressor in accordance with a first embodiment of this invention.

With reference to FIG. 1, the construction of a slant plate type compressor, specifically a wobble plate type refrigerant compressor 10 in accordance with one embodiment of the present invention is shown. Compressor 10 includes cylindrical housing assembly 20 including cylinder block 21, front end plate 23 at one end of cylinder block 21, crank chamber 22 formed between cylinder block 21 and front end plate 23, and rear end plate 24 attached to the other end of cylinder block 21. Front end plate 23 is mounted on cylinder block 21 forward (to the left in FIG. 1) of crank chamber 22 by a plurality of bolts 101. Rear end plate 24 is mounted on cylinder block 21 at is opposite end by a plurality of bolts 102. Valve plate 25 is located between rear end plate 24 and cylinder block 21. Opening 231 is centrally formed in front end plate 23 for supporting drive shaft 26 by bearing 30 disposed in the opening. The inner end portion of drive shaft 26 is rotatably supported by bearing 31 disposed within central bore 210 of cylinder block 21. Bore 210 extends to a rearward end surface of cylinder block 21 to dispose valve control mechanism 19 as discussed below.

Cam rotor 40 is fixed on drive shaft 26 by pin member 261 and rotates with shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is adjacent cam rotor 40 and includes opening 53 through which passes drive shaft 26. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to the longitudinal axis of drive shaft 26.

Wobble plate 60 is rotatably mounted on slant plate 50 through bearings 61 and 62. Fork shaped slider 63 is attached to the outer peripheral end of wobble plate 60 and is slidably mounted on sliding rail 64 held between front end plate 23 and cylinder block 21. Fork shaped slider 63 prevents rotation of wobble plate 60 and wobble plate 60 nutates along rail 64 when cam rotor 40 rotates. Cylinder block 21 includes a plurality of peripherally located cylinder chambers 70 in which pistons 71 reciprocate. Each piston 71 is connected to wobble plate 60 by a corresponding connecting rod 72.

Rear end plate 24 includes peripherally located annular suction chamber 241 and centrally located discharge chamber 251. Valve plate 25 is located between cylinder block 21 and rear end plate 24 and includes a plurality of valved suction ports 242 linking suction chamber 241 with respective cylinders 70. Valve plate 25 also includes a plurality of valved discharge ports 252 linking discharge chambers 251 with respective cylinders 70. Suction ports 242 and discharge ports 252 are provided with suitable reed valves as described in U.S. Pat. No. 4,011,029 to Shimizu.

Suction chamber 241 includes inlet portion 241*a* which is connected to an evaporator of the external cooling circuit (not shown). Discharge chamber 251 is provided with outlet portion 251*a* connected to a condenser of the cooling circuit (not shown). Gaskets 27 and 28 are located between cylinder block 21 and the inner surface of valve plate 25, and the outer surface of valve plate 25 and rear end plate 24 respectively, to seal the mating surfaces of cylinder block 21, valve plate 25 and rear end plate 24.

Figure 2:
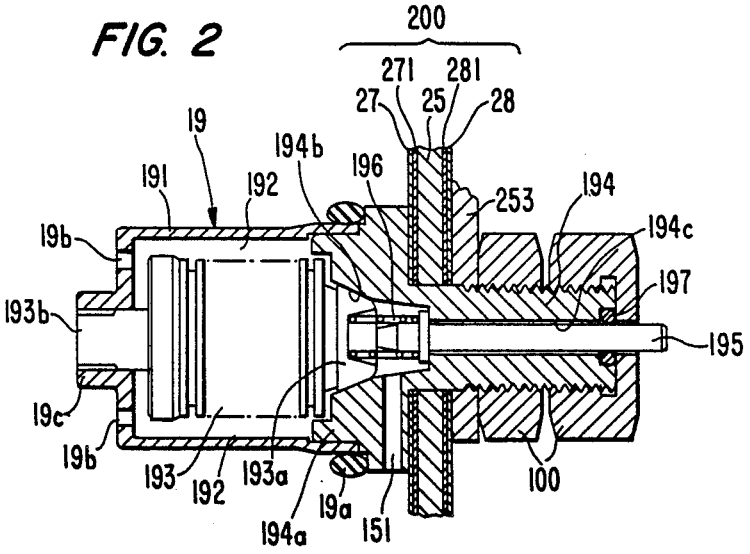
FIG. 2 is an enlarged partially sectional view of a valve control mechanism shown in FIG. 1.
Figure 5:
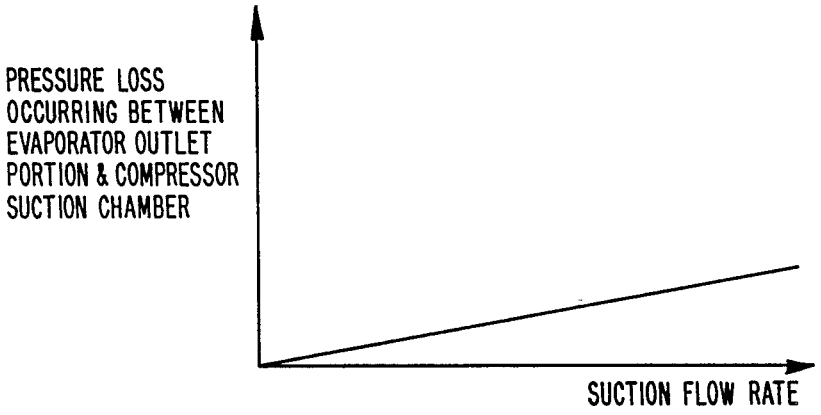
FIG. 5 is a graph showing the relationship between the pressure loss occurring between the evaporator outlet portion and the compressor suction chamber and the suction flow rate.

With reference to FIG. 2, additionally, valve control mechanism 19 includes cup-shaped casing member 191 defining valve chamber 192 therewithin. O-ring 19*a* is disposed between an outer surface of casing member 191 and an inner surface of bore 210 to seal the mating surfaces of casing member 191 and cylinder block 21. A plurality of holes 19*b* are formed at a closed end (to the left in FIGS. 1 and 2) of casing member 191 to lead crank chamber pressure into valve chamber 192 through a gap 31*a* existing between bearing 31 and cylinder block 21. Bellows 193 is disposed in valve chamber 192 to longitudinally contract and expand in response to crank chamber pressure. Projection member 193*b* attached at forward (to the left in FIGS. 1 and 2) end of bellows 193 is secured to axial projection 19*c* formed at a center of closed end of casing member 191. Valve member 193*a* is attached at rearward (to the right in FIGS. 1 and 2) end of bellows 193.

Cylinder member 194 including valve seat 194*a* penetrates a center of valve plate assembly 200 which includes valve plate 25, gaskets 27, 28, suction valve member 271 and discharge valve member 281. Valve seat 194*a* is formed at forward end of cylinder member 194 and is secured to an opened end of casing member 191. Nuts 100 are screwed on cylinder member 194 from a rearward end of cylinder member 194 located in discharge chamber 251 to fix cylinder member 194 to valve plate assembly 200 with valve retainer 253. Conical shaped opening 194*b* receiving valve member 193*a* is formed at valve seat 194*a* and is linked to cylinder 194*c* axially formed in cylinder member 194. Actuating rod 195 is slidably disposed within cylinder 194*c*, slightly projects from the rearward end of cylinder 194*c*, and is linked to valve member 193*a* through bias spring 196. O-ring 197 is disposed between an inner surface of cylinder 194c and an outer surface of actuating rod 195 to seal the mating surfaces of cylinder 194c and actuating rod 195.

Radial hole 151 is formed at valve seat 194a to link conical shaped opening 194b to one end opening of conduit 152 formed at cylinder block 21. Conduit 152 includes cavity 152a and also links to suction chamber 242 through hole 153 formed at valve plate assembly 200. Passageway 150, which provides communication between crank chamber 22 and suction chamber 241, is obtained by uniting gap 31a, bore 210, holes 19b, valve chamber 192, conical shaped opening 194b, radial hole 151, conduit 152 and hole 153.

In result, the opening and closing of passageway 150 is controlled by the contracting and expanding of bellows 193 in response to crank chamber pressure.

During operation of compressor 10, drive shaft 26 is rotated by the engine of the vehicle through an electromagnetic clutch 300. Cam rotor 40 is rotated with drive shaft 26, rotating slant plate 50 as well, which causes wobble plate 60 to nutate. Nutational motion of wobble plate 60 reciprocates pistons 71 in their respective cylinders 70. As pistons 71 are reciprocated, refrigerant gas which is introduced into suction chamber 241 through inlet portion 241a, flows into each cylinder 70 through suction ports 242 and then compressed. The compressed refrigerant gas is discharged to discharge chamber 251 from each cylinder 70 through discharge ports 252, and therefrom into the cooling circuit through outlet portion 251a.

The capacity of compressor 10 is adjusted to maintain a constant pressure in suction chamber 241 in response to a change in the heat load of the evaporator or a change in the rotating speed of the compressor. The capacity of the compressor is adjusted by changing the angle of the slant plate which is dependent upon the crank chamber pressure. An increase in crank chamber pressure decreases the slant angle of the slant plate and thus the wobble plate, decreasing the capacity of the compressor. A decrease in the crank chamber pressure increases the angle of the slant plate and the wobble plate and thus increases the capacity of the compressor.

The effect of the valve control mechanism of the present invention is to maintain a constant pressure at the outlet of the evaporator during capacity control of the compressor in the following manner. Actuating rod 195 pushes valve member 192 in the direction to contract bellows 193 through bias spring 196, which smoothly transmits the force from actuating rod 195 to valve member 193a of bellows 193. Actuating rod 195 is moved in response to receiving discharge pressure in discharge chamber 251. Accordingly, increasing discharge pressure in discharge chamber 251 further moves rod 195 toward bellows 193, thereby increasing tendency to contract bellows 193. As a result, the compressor control point for displacement change is shifted to maintain a constant pressure at the evaporator outlet portion. That is, the valve control mechanism makes use of the fact that the discharge pressure of the compressor is roughly directly proportional to the suction flow rate. Since actuating rod 195 moves in direct response to changes in discharge pressure and applies a force directly to bellows 193 (the controlling valve element), the control point at which bellows 193 operates is shifted in a very direct and responsive manner by changes in discharge pressure.

Figure 3:
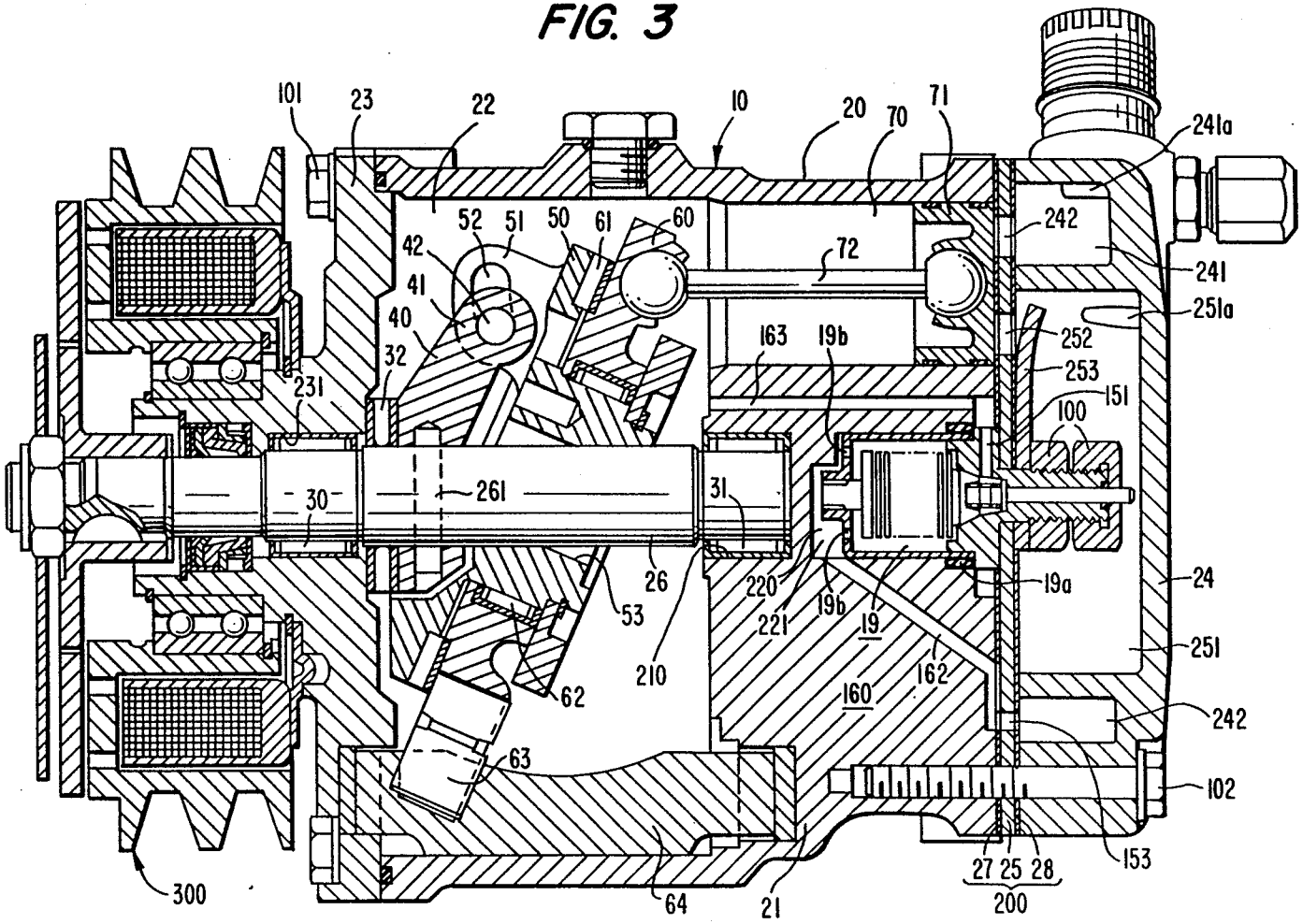
FIG. 3 is a vertical longitudinal sectional view of a wobble plate type refrigerant compressor in accordance with a second embodiment of this invention.

FIG. 3 shows a second embodiment of the present invention in which the same numerals are used to denote the same elements shown in FIGS. 1 and 2. In the second embodiment, cavity 220 disposing valve control mechanism 19 is formed at a central portion of cylinder block 21 and is isolated from bore 210 which rotatably supports drive shaft 26. Holes 19b link valve chamber 192 to space 221 provided at the forward end of cavity 220. Conduit 162, linking space 221 to suction chamber 242 through hole 153, is formed in cylinder block 21 to lead suction chamber pressure into space 221. Conduit 163, linking crank chamber 22 to radial hole 151, is also formed in cylinder block 21. Passageway 160 communicating crank chamber 22 and suction chamber 241 is thus obtained by uniting conduit 163, radial hole 151, conical shaped opening 194b, valve chamber 192, holes 19b, space 221, conduit 162 and hole 153. In result, the opening and closing of passageway 160 is controlled by the contracting and expanding of bellows 193 in response to suction chamber pressure.

Figure 4:
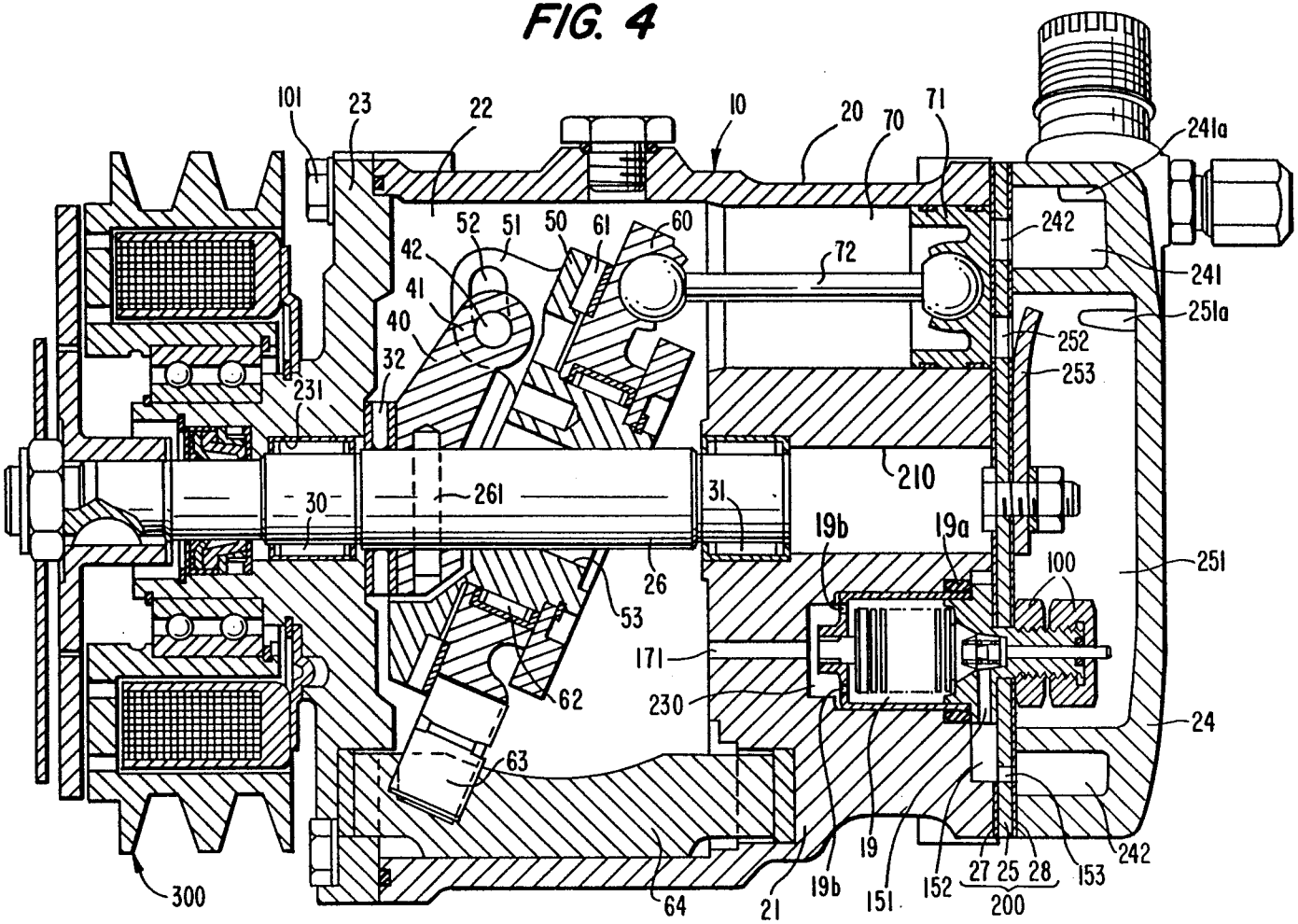
FIG. 4 is a vertical longitudinal sectional view of a wobble plate type refrigerant compressor in accordance with a third embodiment of this invention.

FIG. 4 shows a third embodiment of the present invention in which the same numerals are used to denote the same elements shown in FIGS. 1 and 2. In the third embodiment the cavity, in which the valve control mechanism is disposed, is formed in the cylinder block at a location radially offset from the axis of the drive shaft. That is, cavity 230, receiving the valve control mechanism, is formed in cylinder block 21 at a location radially offset from an axis of drive shaft 26. Conduit 171 is formed in cylinder block 21 to lead crank chamber pressure into valve chamber 192 via holes 19b.

The operation of the valve control mechanisms of the second and third embodiments are substantially similar to that in the first embodiment and a further explanation of these operations are omitted.

This invention has been described in connection with the preferred embodiments. These embodiments, however, are merely for example only and the invention is not restricted thereto. It will be understood by those skilled in the art that other variations and modifications can easily be made within the scope of this invention as defined by the claims.

I claim:

1. In a refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle with respect to said drive shaft, and linking means for operationally linking said slant plate to said pistons such that rotation of said drive shaft, rotor and slant plate reciprocates said pistons in said cylinders, said slant angle changing in response to a change in pressure in said crank chamber to change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, the improvement comprising:

said valve control means comprising a longitudinally expanding and contracting bellows and a valve member attached at one end of said bellows to open and close said passageway, a cylinder member having a first end adjacent to said valve member, and an actuating rod slidably disposed within said cylinder member and receiving the discharge pressure at one end so as to longitudinally move and thereby apply a force to and move said valve member to shift the control point of said bellows in response to changes in discharge pressure.

2. In a refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle with respect to said drive shaft, and linking means for operationally linking said slant plate to said pistons such that rotation of said drive shaft, rotor and slant plate reciprocates said pistons in said cylinders, said slant angle changing in response to a change in pressure in said crank chamber to change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, the improvement comprising:

said valve control means including a valve element primarily responsive to pressure in said suction chamber and opening said passageway when the pressure is above a predetermined response point, and a valve shifting element coupled to said valve element by an elastic element, said valve shifting element responsive to changes in the discharge pressure for applying a force to said valve element to lower the suction pressure response point of said valve element with increasing discharge pressure.

3. The refrigerant compressor recited in claim 2, said elastic element comprising a bias spring.

4. The refrigerant compressor recited in claim 2, said valve element comprising a bellows having a valve member attached at one end thereof, said bellows longitudinally expanding or contracting in response to the suction pressure.

5. The refrigerant compressor recited in claim 2, said coupling means comprising a wobble plate disposed about said drive shaft, said inclined surface of said slant plate in close proximity to said wobble plate, said wobble plate linked to said pistons, rotational motion of said slant plate converted to nutational motion of said wobble plate to reciprocate said pistons in said cylinders.

6. In a refrigerant compressor including a compressor housing having a cylinder block provided with a plurality of cylinders, a front end plate disposed on one end of said cylinder block and enclosing a crank chamber within said cylinder block, a piston slidably fitted within each of said cylinders and reciprocated by a drive mechanism including a rotor connected to a drive shaft, an adjustable slant plate having an inclined surface adjustably connected to said rotor and having an adjustable slant angle with respect to said drive shaft, and linking means for operationally linking said slant plate to said pistons such that rotation of said drive shaft, rotor and slant plate reciprocates said pistons in said cylinders, said slant angle changing in response to a change in pressure in said crank chamber to change the capacity of said compressor, a rear end plate disposed on the opposite end of said cylinder block from said front end plate and defining a suction chamber and a discharge chamber therein, a passageway linking said suction chamber with said crank chamber and a valve control means for controlling the opening and closing of said passageway, the improvement comprising:

said valve control means including a valve element primarily responsive to pressure in said crank chamber and opening said passageway when the crank chamber pressure is above a predetermined response point, and a valve shifting element coupled to said valve element by an elastic element, said valve shifting element responsive to changes in the discharge pressure for applying a force to said valve element to lower the crank chamber pressure response point of said valve element with increasing discharge pressure.

7. The refrigerant compressor recited in claim 6, said elastic element comprising a bias spring.

8. The refrigerant compressor recited in claim 6, said valve element comprising a bellows having a valve member attached at one end thereof, said bellows longitudinally expanding or contracting in response to the crank chamber pressure.

9. The refrigerant compressor recited in claim 6, said coupling means comprising a wobble plate disposed about said drive shaft, said inclined surface of said slant plate in close proximity to said wobble plate, said wobble plate linked to said pistons, rotational motion of said slant plate converted to nutational motion of said wobble plate to reciprocate said pistons in said cylinders.

10. In a slant plate type refrigerant compressor including a compressor housing having a central portion, a front end plate at one end and a rear end plate at its other end, said housing having a cylinder block provided with a plurality of cylinders and a crank chamber adjacent said cylinder block, a piston slidably fitted within each of the said cylinders, a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable to vary the stroke length of said pistons and the capacity of the compressor, said rear end plate having a suction chamber and a discharge chamber, a passageway connected between said crank chamber and said suction chamber, and valve control means for controlling the closing and opening of said passageway to vary the capacity of the compressor by adjusting the incline angle, the improvement comprising:

said valve control means including a valve element opening and closing said passageway and a valve shifting element coupled to said valve element by an elastic element to apply a force to said valve element and shift a control point of said valve element in response to changes in discharge pressure.

11. The refrigerant compressor of claim 1 wherein said elastic element is a bias spring.

12. The refrigerant compressor of claim 1 wherein said valve control means controls the opening and closing of said passageway in response to a change in suction chamber pressure.

13. The refrigerant compressor of claim 1 wherein said valve control means controls the opening and closing of said passageway in response to a change in crank chamber pressure.

14. The slant plate type refrigerant compressor recited in claim 1, said coupling means comprising a wobble plate disposed about said drive shaft, said inclined surface of said member in close proximity to said wobble plate, said wobble plate linked to said pistons, rotational motion of said member converted to nutational motion of said wobble plate to reciprocate said pistons in said cylinders.

15. The refrigerant compressor of claim 1 wherein said valve element comprises a longitudinally expanding and contracting bellows and a valve member attached at one end of said bellows.

16. The refrigerant compressor of claim 15 wherein said valve shifting element comprises a cylinder member and an actuating rod, said cylinder member having a first end adjacent to said valve member of said valve element and a second end, and said actuating rod being slidably disposed within said cylinder member so as to longitudinally move said valve member of said valve element in response to receiving the discharge pressure at one end surface of said actuating rod.

17. The refrigerant compressor of claim 16 wherein said second end of cylinder member is located in said discharge chamber and said one end surface of said actuating rod is disposed at said second end of said cylinder member.

18. The refrigerant compressor of claim 1 wherein a surface of said valve shifting element is acted on by fluid in said discharge chamber.

19. The refrigerant compressor of claim 18 wherein said valve shifting element includes a rod slidable along its length, a first end of said rod coupled to said valve element and a second end having said surface acted on by fluid in said discharge chamber whereby increases in the fluid pressure in said discharge chamber slides said rod toward said valve element to have said first end of said rod apply a force to said valve element.

20. The refrigerant compressor of claim 19 wherein said second end of said rod is disposed in said discharge chamber.

21. The refrigerant compressor of claim 19 wherein said valve element includes a longitudinally expanding and contracting bellows.

* * * * *